US009598850B2

(12) United States Patent
Liston

(10) Patent No.: US 9,598,850 B2
(45) Date of Patent: Mar. 21, 2017

(54) PRECAST STORMWATER INLET FILTER AND TRAP

(71) Applicant: Hanson Pipe & Precast LLC, Irving, TX (US)

(72) Inventor: Patrick William Liston, San Antonio, TX (US)

(73) Assignee: Forterra Pipe & Precast, LLC, Irving, TX (US)

( * ) Notice: Subject to any disclaimer, the term of this patent is extended or adjusted under 35 U.S.C. 154(b) by 35 days.

(21) Appl. No.: 14/206,154

(22) Filed: Mar. 12, 2014

(65) Prior Publication Data

US 2014/0263004 A1 Sep. 18, 2014

Related U.S. Application Data

(60) Provisional application No. 61/782,424, filed on Mar. 14, 2013.

(51) Int. Cl.
*E03F 5/04* (2006.01)
*E03F 5/06* (2006.01)

(52) U.S. Cl.
CPC ..... *E03F 5/0404* (2013.01); *E03F 5/06* (2013.01)

(58) Field of Classification Search
CPC ..... E03F 5/0401; E03F 5/0404; E03F 5/06
USPC ..... 210/163, 164, 170.03, 747.3; 404/4, 5
See application file for complete search history.

(56) References Cited

U.S. PATENT DOCUMENTS 666,077 A 1/1901 Walters
2,793,957 A 5/1957 Mangold et al.
3,351,478 A 11/1967 Dodson et al.
3,416,276 A 12/1968 Caputo et al.
3,712,825 A 1/1973 Yocum
3,847,630 A 11/1974 Compernass et al.
4,205,993 A 6/1980 Rosenberg et al.
4,210,457 A 7/1980 Dodson et al.
4,225,357 A 9/1980 Hodson
4,318,744 A 3/1982 Dodson
4,336,069 A 6/1982 Dodson et al.
4,410,366 A 10/1983 Birchall et al.
(Continued)

FOREIGN PATENT DOCUMENTS

GB 938567 10/1963
GB 1167760 10/1969
(Continued)

OTHER PUBLICATIONS

International Search Report and Written Opinion for Application No. PCT/US2014/025576 dated Sep. 2, 2014.
(Continued)

*Primary Examiner* — Christopher Upton
(74) *Attorney, Agent, or Firm* — RatnerPrestia

(57) ABSTRACT

A filter for a storm water inlet having a surface opening for receiving storm water runoff comprising liquids and solids and discharging said runoff into an interior compartment below having a substantially vertical interior wall or walls defining a cross-sectional area. The filter comprises one or more precast pervious concrete filter elements, the element or elements being formed such that the filter substantially fills the entire cross-sectional area of the interior compartment. Also, a storm water inlet including such a filter, and a method of adding such a filter to a storm water inlet.

23 Claims, 5 Drawing Sheets

(56) References Cited

U.S. PATENT DOCUMENTS

| | | | | |
|---|---|---|---|---|
| 4,946,504 | A | 8/1990 | Hodson | |
| 4,948,429 | A | 8/1990 | Arfaei | |
| 4,964,917 | A | 10/1990 | Bobrowski et al. | |
| 4,978,392 | A | 12/1990 | Kilbarger et al. | |
| 5,026,609 | A | 6/1991 | Jacob et al. | |
| 5,030,502 | A | 7/1991 | Teare | |
| 5,203,629 | A | 4/1993 | Valle et al. | |
| 5,203,919 | A | 4/1993 | Bobrowski et al. | |
| 5,232,587 | A | 8/1993 | Hegemier et al. | |
| 5,284,580 | A | 2/1994 | Shyh | |
| 5,294,256 | A | 3/1994 | Weigand et al. | |
| 5,326,396 | A | 7/1994 | Abdelrazig et al. | |
| 5,350,554 | A | 9/1994 | Miller | |
| 5,375,940 | A * | 12/1994 | Kobayashi | E03F 5/06 404/4 |
| 5,427,617 | A | 6/1995 | Bobrowski et al. | |
| 5,478,391 | A | 12/1995 | Babaev et al. | |
| 5,494,516 | A | 2/1996 | Drs et al. | |
| 5,632,888 | A | 5/1997 | Chinn et al. | |
| 5,665,158 | A | 9/1997 | Darwin et al. | |
| 5,720,574 | A | 2/1998 | Barella | |
| 5,725,782 | A | 3/1998 | Chinn et al. | |
| 5,753,368 | A | 5/1998 | Berke et al. | |
| 5,776,243 | A | 7/1998 | Goodson et al. | |
| 5,779,788 | A | 7/1998 | Berke et al. | |
| 5,785,751 | A | 7/1998 | Bashlykov et al. | |
| 5,788,407 | A | 8/1998 | Hwang | |
| 5,820,762 | A | 10/1998 | Bamer et al. | |
| 5,849,198 | A | 12/1998 | Sharpless | |
| 5,916,361 | A | 6/1999 | Molloy et al. | |
| 5,985,989 | A | 11/1999 | Shawl et al. | |
| 6,010,622 | A | 1/2000 | Chinn et al. | |
| 6,079,175 | A | 6/2000 | Clear | |
| 6,080,307 | A | 6/2000 | Morris et al. | |
| 6,103,783 | A | 8/2000 | Hong | |
| 6,106,707 | A | 8/2000 | Morris et al. | |
| 6,187,409 | B1 | 2/2001 | Mathieu | |
| 6,277,191 | B1 | 8/2001 | Budiansky et al. | |
| 6,277,274 | B1 | 8/2001 | Coffman | |
| 6,287,459 | B1 | 9/2001 | Williamson | |
| 6,302,621 | B1 | 10/2001 | Miya et al. | |
| 6,337,025 | B1 * | 1/2002 | Clemenson | B01J 20/22 210/163 |
| 6,368,499 | B1 | 4/2002 | Sharpless | |
| 6,531,059 | B1 | 3/2003 | Morris et al. | |
| 6,551,505 | B2 | 4/2003 | Chinn et al. | |
| 6,569,321 | B2 | 5/2003 | Coffman | |
| 6,660,077 | B2 | 12/2003 | De Buen-Unna et al. | |
| 6,719,910 | B1 | 4/2004 | Thiem et al. | |
| 6,749,366 | B1 | 6/2004 | Chinn et al. | |
| 6,758,897 | B2 | 7/2004 | Rieder et al. | |
| 6,767,160 | B2 | 7/2004 | Sansalone | |
| 6,773,646 | B2 | 8/2004 | Rieder et al. | |
| 6,797,162 | B2 | 9/2004 | Happel | |
| 6,824,605 | B2 | 11/2004 | De Buen-Unna et al. | |
| 6,863,969 | B2 | 3/2005 | Rieder et al. | |
| 6,872,029 | B2 | 3/2005 | Allard et al. | |
| 6,875,265 | B1 | 4/2005 | Kang | |
| 6,884,343 | B2 | 4/2005 | Harris et al. | |
| 6,905,289 | B1 | 6/2005 | Sanguinetti | |
| 7,037,367 | B2 | 5/2006 | Mauchamp et al. | |
| 7,080,480 | B2 | 7/2006 | Urban et al. | |
| 7,083,721 | B2 | 8/2006 | McClure et al. | |
| 7,094,338 | B2 | 8/2006 | Morris et al. | |
| 7,128,781 | B1 | 10/2006 | Piazza | |
| 7,147,706 | B1 | 12/2006 | Piazza | |
| 7,270,747 | B2 | 9/2007 | Happel et al. | |
| 7,294,256 | B2 | 11/2007 | Happel et al. | |
| 7,300,892 | B2 | 11/2007 | Porter | |
| 7,396,495 | B2 | 7/2008 | Friesner | |
| 7,462,236 | B2 | 12/2008 | Chun et al. | |
| D596,697 | S | 7/2009 | Siviter et al. | |
| 7,575,393 | B2 | 8/2009 | Sansalone | |
| 7,625,485 | B2 | 12/2009 | Siviter et al. | |
| 7,632,403 | B2 | 12/2009 | Dierkes | |
| 7,638,066 | B1 | 12/2009 | Jacob et al. | |
| 7,833,412 | B2 | 11/2010 | Holtz | |
| 7,837,868 | B2 | 11/2010 | Jacob et al. | |
| 7,922,916 | B1 | 4/2011 | Witt | |
| 7,981,283 | B2 | 7/2011 | Happel | |
| 8,323,485 | B2 * | 12/2012 | Blundell | E03F 5/0404 210/163 |
| 2002/0031402 | A1 | 3/2002 | French | |
| 2002/0055558 | A1 | 5/2002 | Maehara et al. | |
| 2002/0057944 | A1 | 5/2002 | Adams et al. | |
| 2002/0073898 | A1 | 6/2002 | Schelinski | |
| 2003/0047502 | A1 | 3/2003 | Roberts et al. | |
| 2003/0061970 | A1 | 4/2003 | De Buen-Unna et al. | |
| 2003/0150362 | A1 | 8/2003 | De Buen-Unna et al. | |
| 2004/0035772 | A1 | 2/2004 | McGinn | |
| 2006/0157423 | A1 | 7/2006 | Cleary | |
| 2006/0159517 | A1 | 7/2006 | Hagerman et al. | |
| 2006/0163147 | A1 | 7/2006 | Dierkes et al. | |
| 2006/0237369 | A1 | 10/2006 | Kirts et al. | |
| 2008/0023404 | A1 | 1/2008 | Majersky | |
| 2008/0023408 | A1 | 1/2008 | Hansen | |
| 2008/0058461 | A1 | 3/2008 | Cummins | |
| 2008/0121579 | A1 | 5/2008 | Dierkes | |
| 2008/0121594 | A1 | 5/2008 | Dierkes | |
| 2008/0245710 | A1 | 10/2008 | Mitchell et al. | |
| 2009/0039022 | A1 | 2/2009 | Belasco | |
| 2009/0071376 | A1 | 3/2009 | Masloff et al. | |
| 2009/0180833 | A1 | 7/2009 | Buch | |
| 2009/0314723 | A1 | 12/2009 | Jacob et al. | |
| 2010/0025313 | A1 | 2/2010 | Dierkes | |
| 2010/0051525 | A1 | 3/2010 | Jacob et al. | |
| 2010/0058957 | A1 | 3/2010 | Boxley | |
| 2010/0108617 | A1 | 5/2010 | Schmidt et al. | |
| 2010/0150654 | A1 | 6/2010 | Shaw et al. | |
| 2010/0285224 | A1 | 11/2010 | Fisher | |
| 2011/0064517 | A1 | 3/2011 | Sader | |
| 2011/0230598 | A1 | 9/2011 | Sorger et al. | |
| 2011/0247973 | A1 | 10/2011 | Sargand et al. | |
| 2011/0250013 | A1 | 10/2011 | Buch | |
| 2011/0274488 | A1 | 11/2011 | Novick et al. | |
| 2012/0228234 | A1 * | 9/2012 | Price | E03F 5/0404 210/747.3 |

FOREIGN PATENT DOCUMENTS

| | | |
|---|---|---|
| JP | 05-255966 | 10/1993 |
| JP | 2003-020715 A | 1/2003 |
| KR | 20-0405382 | 1/2006 |

OTHER PUBLICATIONS

Grace Construction Products, "Pervious Concrete Mix Proportioning," Technical Bulletin TB-0111, 2006, pp. 1-2.

Schaefer, et al., "Mix Design Development for Pervious Concrete in Cold Weather Climates," Center for Transportation Research and Education, Iowa State University, Feb. 2006, pp. XI-45.

American Concrete Institute, "Specification for Pervious Concrete Pavement, an ACI Standard", ACI 522.1-08, Mar. 2008, pp. 1-11.

Blackburn, Rick, "Pervious Concrete, Practical Application of Pervious Concrete: Mix Designs that are Workable," NRMCA Conference, Axim Italcementi Group, May 2006, pp. 1-20.

"Mix Design and Materials," Pervious Concrete, When it Rains . . . it Drains, http://www.perviouspavement.org/mixture_proportioning.htm, retrieved Mar. 25, 2011, pp. 1-4.

National Concrete Pavement Technology Center, "Mix Design Development for Pervious Concrete in Cold Weather Climates," Feb. 2006, pp. 1-3.

Youngs, Andy, "Pervious Concrete the California Experience," pp. 1-6.

IRMCA Indiana Ready Mixed Concrete Associations, "IRMCA Pervious Concrete—Key Points," pp. 1-7.

Tennis et al., "Pervious Concrete Pavements," Portland Cement Associations, National Ready Mixed Concrete Association, 2004, pp. i-28.

(56) References Cited

OTHER PUBLICATIONS

Portland Cement Association, "Cement & Concrete Basics, Frequently Asked Questions," http://www.cement.org/basics/concretebasics_faqs.asp, retrieved Mar. 25, 2011.
Halverson, et al., "Void Continuity Index for Pervious Concretes Using X-Ray Computed Tomography Scanning," pp. 50-67.
Propex Concrete Systems, "Fibermesh 150 Product Data Sheet," 2007, pp. 1-2.
"Propex Material Safety Data Sheet, Polypropylene Fibers for Concrete Reinforcement," pp. 1-6.
Bhutta, et al., "Recent Status of Research and Development of Concrete-Polymer Composites in Japan," Concrete Research letters, vol. 1(4), Dec. 2010, pp. 125-130.
NPCPA, Mix Design Calculator, http://2.bp.blogspot.com/__KxIFNLYCX__Y/TUG9j3YLnzI/AAAAAAAAAD0/64jyxY8GZYc/s1600/Calculator.JPG, 2011, p. 1.
"Silicon Dioxide," Wikipedia, http://en.wikipedia.org/wiki/Silicon_dioxide, retrieved Sep. 21, 2011, pp. 1-13.
Grace Construction Products, "Using V-MAR 3 (Rheology Modifying Admixture) to Reduce Concrete Pump Pressure," Technical Bulletin TB-1402, 2005, pp. 1-4.
Grace Concrete Products, "WRDA 64 Water-reducing admixture, ASTM C494 Type A and D," Pamphlet, 2007, pp. 1-2.
W.R. Grace, "Material Safety Data Sheet, Product Name WRDS 64 CR-2409," Jun. 19, 2009, pp. 1-4.
Grace Concrete Products, "ADVA 190, High-range water-reducing admixture, ASTM C494 Type A and F, and ASTM C1017 Type I," Pamphlet, 2007, pp. 1-2.
W.R. Grace, "Material Safety Data Sheet, Product Name ADVA 190," Apr. 18, 2007, pp. 1-4.
Grace Concrete Products, "Recover Hydration Stabilizer, ASTM C494 Type D," Pamphlet, 2007, pp. 1-2.
W.R. Grace, "Material Safety Data Sheet, Product Name RECOVER," Jan. 20, 2009, pp. 1-4.
"Water reducer," Wikipedia, http://en.wikipedia.org/wiki/Water_reducer, retrieved Mar. 8, 2012 p. 1.
"Plasticizer," Wikipedia, http://en.wikipedia.org/wiki/Plasticizer, retrieved May 3, 2011, pp. 1-6.
"Plasticizer," Wikipedia, http://en.wikipedia.org/wiki/Plasticizer, retrieved Mar. 8, 2012, pp. 1-6.
"Superplasticizer," Wikipedia, http://en.wikipedia.org/wiki/Superplasticizer, retrieved Mar. 8, 2012, pp. 1-2.
Dierkes et al., "Development and Investigation of a Pollution Control Pit for Treatment of Stormwater from Metal Roofs and Traffic Areas," 10$^{th}$ International Conference on Urban Drainage, Aug. 21-26, 2005, pp. 1-8, Copenhagen/Denmark.
Taghizadeh et al., "Feasibility Study of Water Purification Using Vertical Porous Concrete Filter," Int. J. Environ. Sci. Tech., 2007, pp. 505-512, vol. 4, No. 4.
Majersky, Gregory Michael, "Filtration of Polluted Waters by Pervious Concrete," power point presentation for 5$^{th}$ Annual RMSAWWA/RMWEA Student Research Conference, May 13, 2008, pp. 1-18.
"Stormwater Inlet Protection," Dane County Erosion Control and Stormwater Management Manual, Jan. 2, 2007, pp. I.S-13.1 to I.S-13.6.
"Section 5: Storm Drain Inlets," Hydraulic Design Manual: Storm Drain Inlets, retrieved Nov. 30, 2011, pp. 1-20, http://onlinemanuals.txtdot.gov/txdotmanuals/hyd/storm_drain_inlets.htm.
Wolfe, Bruce H., "Use of Storm Drain Inlet Filters and Oil/Water Separators to Meet the Requirements of NPDES Municipal Stormwater Permits," Letter from California Regional Water Quality Control Board to BASMAA Managers, Aug. 5, 2004.
Suntree Technologies, Inc., "Grate Inlet Skimmer Box" pamphlet, pp. 1-6.
Clean Way pamphlet, "High Performance Catch Basin Filtration Inserts," pp. 1-4.
Pitt et al., "Module 10b: Gutter and Inlet Designs and Multiple Design Objectives," power point presentation, pp. 1-11.
Filterra Bioretention Systems pamphlet, p. 1.
Metropolitan Council/Barr Engineering Co., "Inlet Protection," Minnesota Urban Small Sites BMP Manual, 2000, pp. 3-113 to 3-120.
Suntree Technologies, Inc., "Curb Inlet Basket" pamphlet, pp. 1-2.
Revel Environmental Manufacturing, Inc., "Triton Filter Curb Inlet Filter Insert" pamphlet, pp. 1-2.
Dauphin County Conservation District, Best Management Practices Fact Sheet Inlet Protection, p. 1.
Precast Solutions pamphlet, "Stormwater Treatment Drain Inserts," pp. 1-2.
Royal Environmental Systems Inc., pamphlet, "ecoStorm plus treatement process characteristics," pp. 14.
Pollution Solution, Inc., Silt Sifter Bag pamphlet, "Sediment/Erosion Control Done Right," pp. 1-2.
Pollution Solution, Inc., Silt Sifter Tube pamphlet, "Sediment/Erosion Control Done Right," pp. 1-2.
Pollution Solution, Inc., Gravel Bags pamphlet, "Sediment/Erosion Control Done Right," pp. 1-2.
Pollution Solution, Inc., Curb Inlet Filter pamphlet, "Sediment/Erosion Control Done Right," pp. 1-2.
Pollution Solution, Inc., YellowJacket Drain Inlet Filter pamphlet, "Sediment/Erosion Control Done Right," pp. 1-2.
Pollution Solution, Inc., Hornet's Nest Drain Inlet Filter pamphlet, "Sediment/Erosion Control Done Right," pp. 1-2.
Pollution Solution, Inc., Above Ground Grated Filter (AGG Filter) pamphlet, "Sediment/Erosion Control Done Right," pp. 1-2.
Pollution Solution, Inc., Solid Frame Filter pamphlet, "Sediment/Erosion Control Done Right," pp. 1-2.
Pollution Solution, Inc., D-Watering Bag pamphlet, "Sediment/Erosion Control Done Right," pp. 1-2.
Pollution Solution, Inc., Silt Sifter D-Watering Sleeve pamphlet, "Sediment/Erosion Control Done Right," pp. 1-2.
Pollution Solution, Inc., Straw Wattle pamphlet, "Sediment/Erosion Control Done Right," pp. 1-3.
Jensen Precast, "Ditch Box 18"×36" Curb Inlet Fabricated Frame & Grate," Nov. 24, 2004, p. 1.
Jensen Precast, "No. 243 Curb Inlet with Frame and Cover," Apr. 2, 2008, p. 1.
Jensen Precast, "Curb Inlet and Catch Basin City of West Sacramento Detail 301," Apr. 11, 2007, p. 1.
Jensen Precast, "Curb Inlet 33" I.D. With 5" Walls (Curb Poured in Field)," Oct. 1, 2009, p. 1.
Jensen Precast, "Curb Inlet Sacramento County Type G," Apr. 11, 2007, p. 1.
Jensen Precast, "2436-1A 24"×36" Curb Inlet with Cast Iron Hood, Fabricated Frame & Grate," Apr. 3, 2008, pp. 1-2.
Jensen Precast, "2436-4R 24"×36" Curb Inlet with Cast Iron Frame, Grate, and Hood," Apr. 4, 2008, pp. 1-2.
Jensen Precast, "Type A Curb Inlet 3636 Material up to 6 Foot Depth," Mar. 3, 2010, p. 1.
Jensen Precast, "Type A Curb Inlet 48" Manhole Material Greater than 6 Foot Depth," Mar. 3, 2010, p. 1.
Jensen Precast, "Type C Field Inlet 2436 Material up to 4 Foot Depth," Feb. 15, 2010, p. 1.
Jensen Precast, "Type C Field Inlet 48" manhole Material Greater Than 4 Foot Depth," Mar. 3, 2010, p. 1.
Jensen Precast, "DI2436 24"×36" Curb Inlet With Cast Iron Frame Grate, and Hood," Sep. 6, 2001, pp. 1-2.
Jensen Precast, "2436 Curb Inlet 24"×36" Curb Inlet With Cast Iron Hood, Fabricated Frame & Grate," Apr. 23, 2003, p. 1.
International Preliminary Report on Patentability for Application No. PCT/US2014/025576 dated Sep. 15, 2015.

* cited by examiner

PRECAST STORMWATER INLET FILTER AND TRAP

CROSS REFERENCE TO RELATED APPLICATION

This application claims the benefit of priority to provisional application Ser. No. 61/782,424 filed Mar. 14, 2013, which is incorporated herein by reference in its entirety.

FIELD OF THE INVENTION

This invention relates generally to storm water inlets, and more specifically to a storm water inlet having a precast porous concrete filter, and to a method of making a storm water inlet with a precast porous concrete filter.

BACKGROUND OF THE INVENTION

Streets, parking lots, and other paved surfaces for vehicular and pedestrian traffic are designed and built with storm drains or storm water inlets to drain the storm waters that these surfaces collect. On streets such drains often are located periodically along curbs and shoulders. Paved surfaces are typically graded in such a manner so that water falling onto the surface should flow to one or more of the storm drains. This prevents water from collecting on the surface and the attendant problems associated with flooding, such as inhibiting the flow of traffic, and spillover onto adjacent lands and structures.

A typical storm water inlet has a surface opening that sits above a vertical-walled chamber called a catch basin, which is connected to a sewer system by one or more pipes entering the chamber through openings in the vertical walls. In a common design the catch basin sits on the edge of a roadway inside of the curb, and the surface opening is covered with a grate. This grate enables water to flow into the catch basin but prevents large objects from passing into the catch basin and blocking the sewer pipe. Other designs are built into the curb and have a simple "fall-in" opening in the curb. Still other designs have a combination of these or other features. In virtually all storm water inlet designs, the catch basin is intended to collect debris that is washed in by the force of flowing water. As a result, storm water inlets require periodic maintenance to remove the collected debris collected in the catch basin. For this purpose access to the interior compartment of the catch basin is provided through removal of the grate covering the surface opening or a manhole cover where no such grate is present.

Storm water is frequently laden with trash, leaves and other organic debris, as well as sand, gravel, and other forms of sediment collected from streets, parking lots, and other paved areas. As storm water flows over a street or parking lot to a storm sewer, it also gathers other solid and fluid contaminants deposited on the surface, including oil, grease, fuel, hydraulic fluid, and metals from the vehicles that traverse these paved surfaces. Federal, state, and local standards for regulation of storm water runoff place ever-stricter limits on the discharge of organic, metallic, and other contaminants into downstream waterways. Storm water runoff that passes into many storm drains frequently fails to meet the applicable standards due to the excessive dissolved or suspended contaminants such as petroleum-based materials and metals that wash into the drains with the storm water. This problem has led to a plethora of prior art devices and systems for filtering and/or purifying storm water runoff water that passes into a storm drain.

One class of devices involves a barrier or other filter medium placed around, over, or on top of the drain opening at or above the surface level of the drain. Typical of such devices are those disclosed in U.S. Pat. No. 5,403,474, U.S. Pat. No. 5,632,888, U.S. Pat. No. 5,725,782, U.S. Pat. No. 6,010,622, and U.S. Pat. No. 6,749,366. In many of these prior art devices, the filters are placed or protrude above the level of the drained surface, creating an obstruction, or are only temporary installations designed to address acute runoff conditions during, for example, construction, etc.

In another class of devices, an absorbent filter medium is placed or suspended below the storm water inlet to filter and remove oil, grease, and other non-volatile organic contaminants that enter with the runoff. Such devices are exemplified in the disclosures of U.S. Pat. No. 5,820,762, U.S. Pat. No. 5,849,198, U.S. Pat. No. 6,368,499, and U.S. Pat. No. 6,872,029, as well as U.S. Patent App. Pub. No. US 2008/0023408 A1. Still another class of devices involves placing a basket or trap, alone or in combination with other filter devices and/or media, in or below the storm water inlet, as exemplified in the disclosures of U.S. Pat. No. 5,232,587, U.S. Pat. No. 5,284,580, U.S. Pat. No. 5,720,574, U.S. Pat. No. 6,080,307, U.S. Pat. No. 6,106,707, U.S. Pat. No. 6,287,459, U.S. Pat. No. 6,531,059, U.S. Pat. No. 6,797,162, U.S. Pat. No. 6,884,343, U.S. Pat. No. 7,083,721, U.S. Pat. No. 7,094,338, U.S. Pat. No. 7,270,747, and U.S. Pat. No. 7,922,916, as well as U.S. Patent App. Pub. No. US 2002/0057944 A1. Many of these devices have one or more drawbacks, including a bypass for overflow conditions that allows runoff to evade treatment entirely during excess flow conditions, or a catch mechanism formed of an open grate or mesh that allows small particulates and/or dissolved and suspended materials to pass unimpeded into downstream sewage systems and waterways.

More recently there has been a trend toward more complex systems using multiple filter media, incorporating plantings and other living materials, or having extensive underground mechanical operations. Such devices are exemplified in the disclosures of U.S. Pat. No. 6,277,274, U.S. Pat. No. 6,569,321, U.S. Pat. No. 6,719,910, U.S. Pat. No. 7,080,480, U.S. Pat. No. 7,625,485, U.S. Pat. No. 7,632,403, U.S. Pat. No. 7,638,066, U.S. Pat. No. 7,833,412, and U.S. Pat. No. 7,837,868, as well as U.S. Patent App. Pubs. No. US 2003/0047502 A1, No. 2006/0157423 A1, No. 2006/0163147 A1, No. 2008/0121579 A1, No. 2008/0121594 A1, No. 2008/0245710 A1, No. 2009/0039022 A1, No. 2010/0108617 A1, No. 2010/0150654 A1, No. 2010/0025313 A1, and No. 2011/0247973 A1.

A need therefore remains for a simple, effective filter device that can be retroactively fitted to a storm water inlet, wherein the device does not protrude or extend above street level or otherwise cause an obstruction on the surface being drained, that is capable of removing large objects, sediment and other suspended particulates, and metal and petroleum-based contaminants, and that does not allow storm water to bypass the treatment element entirely during any conditions. These needs are provided for by the present invention, as set forth in the description and claims that follow.

SUMMARY OF THE INVENTION

The problems encountered in effectively treating storm water runoff in a storm water inlet are resolved in many respects by the present invention.

In a first aspect, the invention is a filter for a storm water inlet having a surface opening for receiving storm water runoff containing liquids and solids. The opening discharges the runoff into an interior compartment below the opening having a substantially vertical interior wall or walls defining a cross-sectional area. The filter includes one or more molded, porous filter elements, and the filter element or elements are formed such that the filter substantially fills the entire cross-sectional area of the interior compartment.

In a second aspect, the invention is a storm water inlet, including a surface opening for receiving storm water runoff containing liquids and solids and discharging the runoff into an interior compartment below the opening. The interior compartment has a substantially vertical interior wall or walls defining a cross-sectional area. The storm water inlet further includes a filter formed of one or more molded, porous filter elements, wherein the element or elements are formed such that the filter substantially fills the entire cross-sectional area of the interior compartment.

In a third aspect, the invention is method of adding a filter to a storm water inlet that comprises a surface opening for receiving storm water runoff comprising liquids and solids and discharging said runoff into an interior compartment below the opening, wherein the interior compartment has a substantially vertical interior wall or walls defining a cross-sectional area. The method includes determining the shape of the cross-sectional area of the interior compartment, and casting and hardening a porous material to form one or more filter elements, wherein the filter element or elements form a filter that substantially fills the entire cross-sectional area of the interior compartment below the surface opening, and substantially all runoff entering the interior compartment will encounter the filter.

BRIEF DESCRIPTION OF THE DRAWINGS

The foregoing summary and the following description will be better understood when reviewed in conjunction with the drawing figures, of which.

DETAILED DESCRIPTION OF PREFERRED EMBODIMENTS OF THE INVENTION

Figure 1:
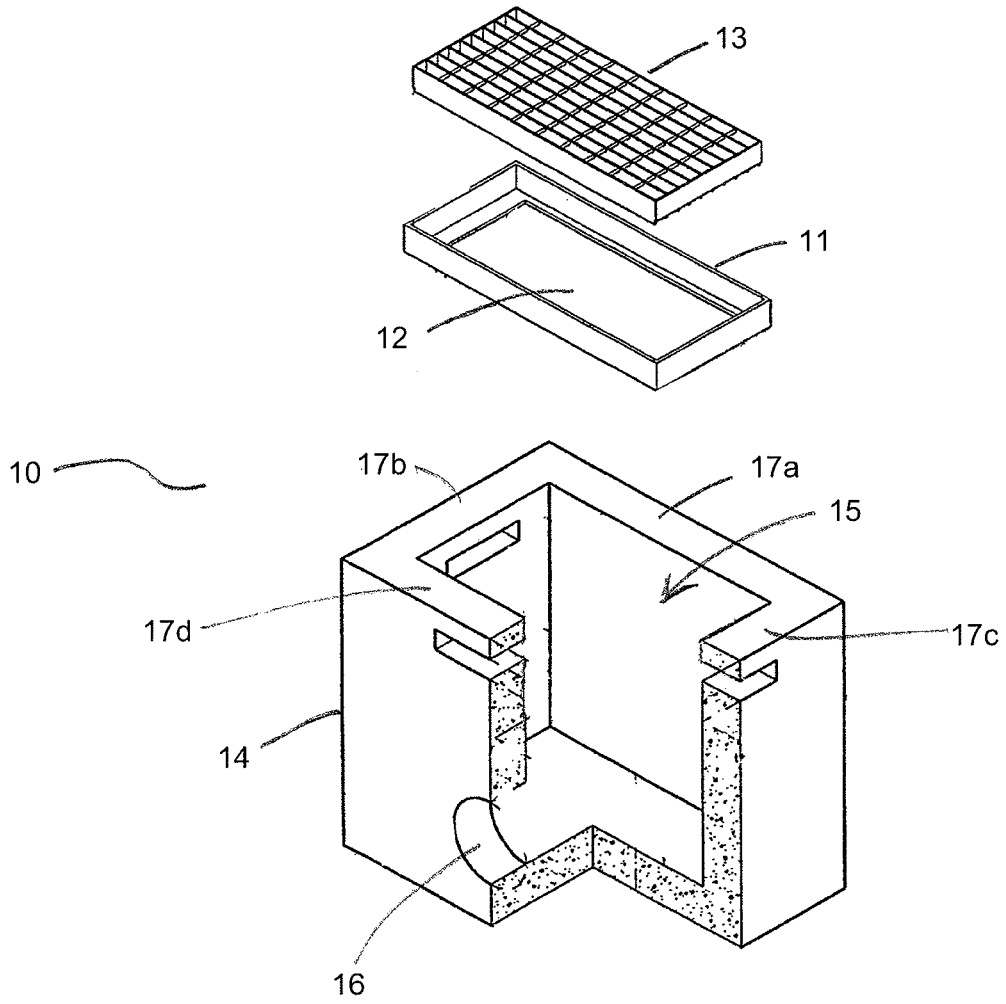
FIG. 1 is a perspective cutaway assembly view of a typical standard ditch box storm water inlet having a top grate, grate frame, and rectangular vertical walls.

Although the invention is illustrated and described herein with reference to specific embodiments, the invention is not intended to be limited to the details shown. Rather, various modifications may be made in the details within the scope and range of equivalents of the claims and without departing from the invention.

Pervious concrete (also known as also referred to as porous concrete, permeable concrete, no-fines concrete, gap-graded concrete, or enhanced-porosity concrete) is a form of concrete with an open-pore structure that even after curing allows water to penetrate and pass through the hardened material. Mix designs for pervious concretes will vary depending on the application and operating conditions, but pervious concrete mixes are characterized generally by low water/cement ratio, low slump, narrowly graded coarse aggregate, and little or no fine aggregate compared to standard, non-pervious mixes. It is held together by cementitious paste at the coarse aggregate contact points and has an open-pore structure since there is limited paste and fine aggregate to fill the resulting voids.

Generally, a pervious concrete mix according to aspects of the present invention contains the following basic ingredients: water, a cementitious material including portland cement and optionally a supplementary cementitious material, aggregate, and optionally one or more typical concrete mix additives, such as water reducers, retarders, viscosity modifiers, fibers, bonding agents, etc. A pervious concrete mix design may include from 375 lbs/yd$^3$ to 700 lbs/yd$^3$ of cementitious material and 2000 lbs/yd$^3$ to 3000 lbs/yd$^3$ of aggregate sized for pervious concrete, with a water to cementitious material ratio of 0.20 to 0.45. These materials and amounts may be varied by those of skill according to the demands and requirements of a particular application and are not intended to limit of this or any other embodiment of the invention except as expressly described or claimed. An ideal pervious concrete mix is characterized as having an oily or metallic sheen on the cementitious paste, and a consistency such that a handful of the paste, when squeezed, will neither stick excessively nor separate completely from the hand, leaving only a scattering of aggregate and paste on the surface.

A general description of pervious concrete mix designs may be found in Design Guide 211 published by the American Concrete Institute (ACI). Other exemplary pervious concrete mix designs have been published by, for example, the California Nevada Cement Promotion Council, the Indiana Ready Mixed Concrete Association, the National Concrete Pavement Technology Center at Iowa State University, and the National Ready Mixed Concrete Association, among others. Variation from these published and other known pervious concrete mix designs by those of skill may be required to obtain a desired porosity, in view of available materials, or to obtain a desired strength in view of acceptable porosity, without departing from the present invention.

The void content of pervious concrete may range from about 15% to about 35% by volume of the cured material. The lower limit of void content in a pervious concrete according to aspects of the present invention can be as low as at least 10% by volume, preferably at least 11%, 12%, 13%, 14%, 15%, 16%, 17%, 18%, 19%, or 20% by volume. The upper limit of void content in the pervious concrete according to aspects of the present invention can be up to 35% by volume or more, preferably up to 34%, 33%, 32%, 31%, 30%, 29% m, 28%, 27%, 26%, or 25% by volume. Such void fractions typically correspond to water drainage rates of about 2 gal/ft$^2$-min to about 18 gal/ft$^2$-min. A pervious concrete according to aspects of the present invention may have a hydraulic conductivity (coefficient of permeability) of about 30 in/hr up to about 900 in/hr, with 480 in/hr (0.34 cm/sec, corresponding to about 5 gal/ft$^2$-min or 200 L/m$^2$-min) being typical.

In a first aspect, the present invention is a filter for a storm water inlet having a surface opening which receives storm water runoff from the surface being drained and discharges the runoff containing liquids and dissolved and suspended solids into an interior compartment below the surface opening. Although the present invention filter can be used in many different types of storm water inlets, the filter is particularly well suited for use in precast, concrete curbside storm inlets that are commonly designed into the sides of paved streets. As a result, by way of example, the filter of this invention will be described in conjunction with typical curbside storm water inlets in order to set forth the best mode contemplated for the practice of the present invention.

Referring now to FIG. 1, a common ditch box storm water inlet 10 is shown in a perspective cutaway assembly view. The inlet 10 includes a metal grate frame 11 supporting a metal top grate 13 covering the surface opening 12, into which runoff draining from the street surface above falls through the grate 13 into the interior compartment 15 of precast concrete catch basin 14. The interior compartment 15 of the catch basin 14 is bounded by vertical walls 17*a*, 17*b*, 17*c*, and 17*d*, which form a rectangular cross-sectional area as the walls 17*a*, 17*b*, 17*c*, and 17*d* extend vertically down from the surface opening 12 to the bottom of the catch basin 14. The catch basin 14 is provided with an outlet opening 16 for connecting, e.g., to a sewer system or other downstream body of water.

Figure 2:
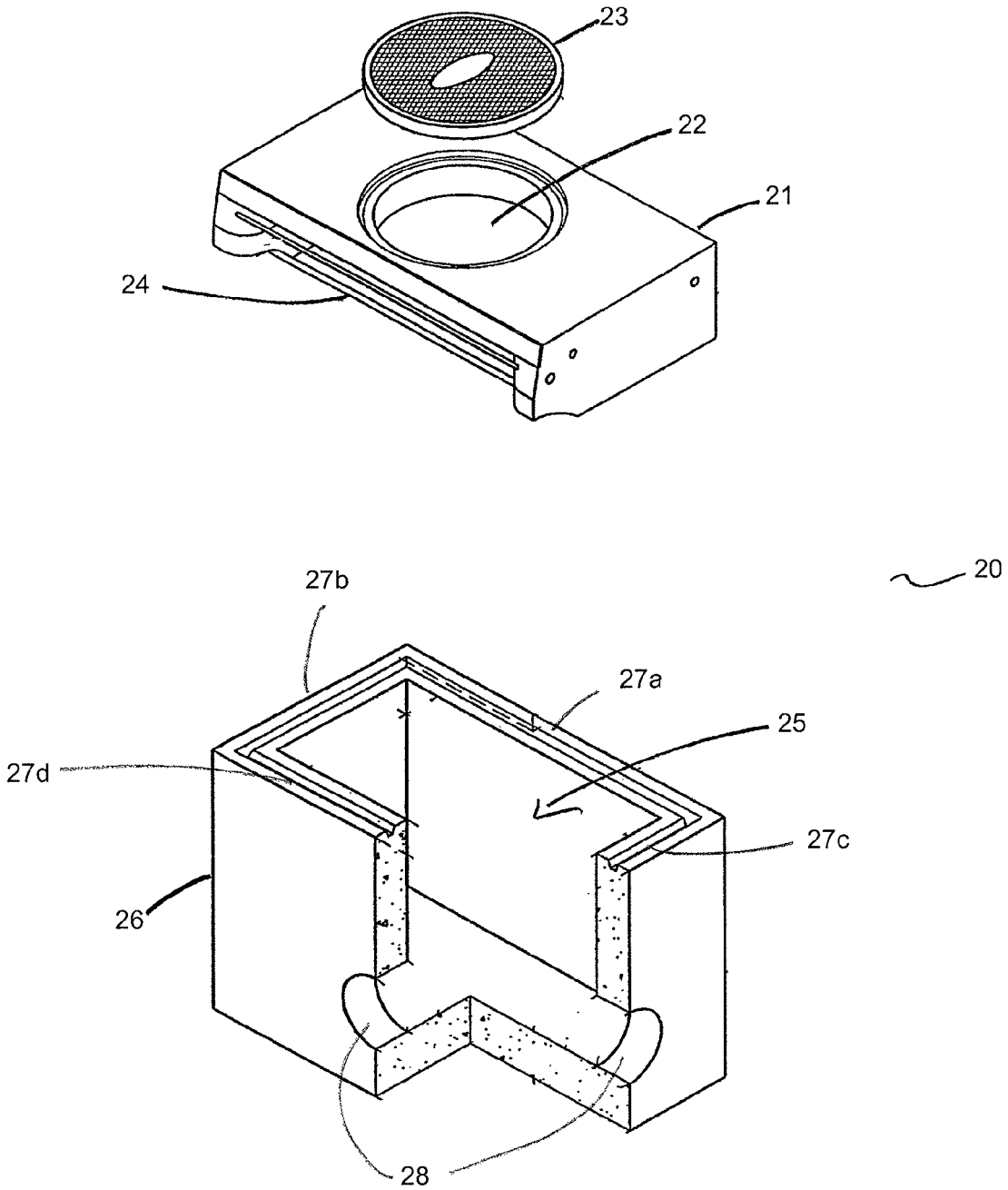
FIG. 2 is a perspective cutaway assembly view of a standard curb inlet and catch basin having a manhole and rectangular vertical walls.

Referring now to FIG. 2, a common curb inlet and catch basin 20 is shown in a perspective cutaway assembly view. The curb inlet and catch basin 20 includes a metal curb top 21 having a manhole 22, a metal manhole cover 23, and a "fall-in" type surface opening 24, through which runoff draining from the street surface above falls into the interior compartment 25 of precast concrete catch basin 26. The interior compartment 25 of the catch basin 26 is bounded by vertical walls 27*a*, 27*b*, 27*c*, and 27*d*, which form a rectangular cross-sectional area as the walls 27*a*, 27*b*, 27*c*, and 27*d* extend vertically down from the surface opening 24 to the bottom of the catch basin 26. The catch basin 26 is provided with an outlet openings 28 for connecting to a sewer system or other downstream body of water.

Figure 3:
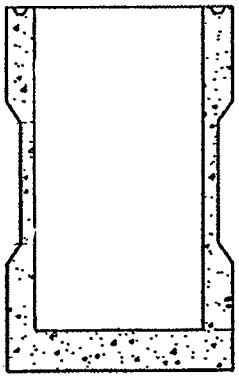
FIG. 3 is a side elevation cutaway of the catch basin portion of a standard curb inlet having a circular vertical wall.
Figure 4:
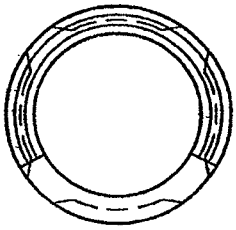
FIG. 4 is a top plan view the catch basin portion of a standard curb inlet having a circular vertical wall depicted in FIG. 3.
Figure 5:
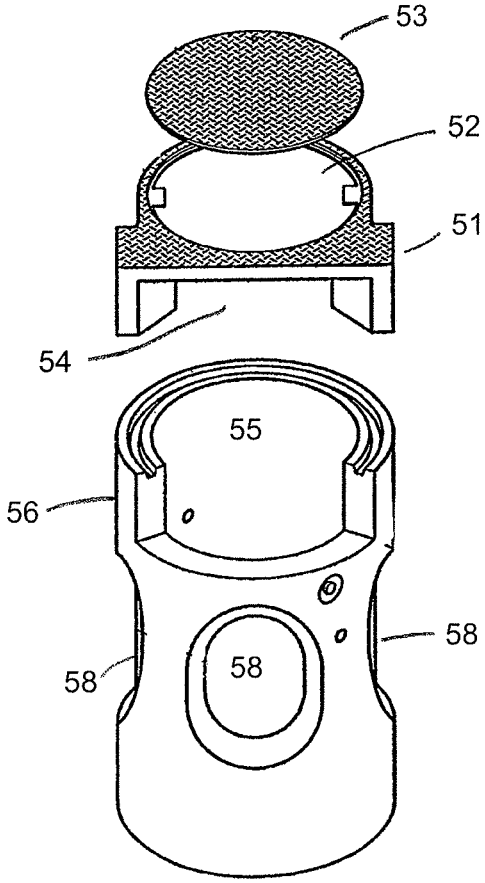
FIG. 5 is a perspective cutaway assembly view of a standard curb inlet having a manhole and a circular vertical wall.

Referring now to FIGS. 1-3, another common curb inlet is shown. FIG. 3 is a side elevation cutaway view of the catch basin showing the connecting openings; FIG. 4 is a top plan view the catch basin showing the surface opening and the circular cross-section of the basin vertical wall. FIG. 5 shows the inlet in a perspective cutaway assembly view. The inlet 50 includes a metal curb top 51 having a manhole 52, a metal manhole cover 53, and a "fall-in" type surface opening 54, through which runoff draining from the street surface above falls into the interior compartment 55 of precast concrete catch basin 56. The interior compartment 25 of the catch basin 26 is bounded by a vertical wall 57, which forms a circular cross-sectional area as the wall 57 extends vertically down from the surface opening 54 to the bottom of the catch basin 56. The catch basin 56 is provided with an outlet openings 58 for connecting to, e.g., a sewer system or other downstream body of water.

Figure 6:
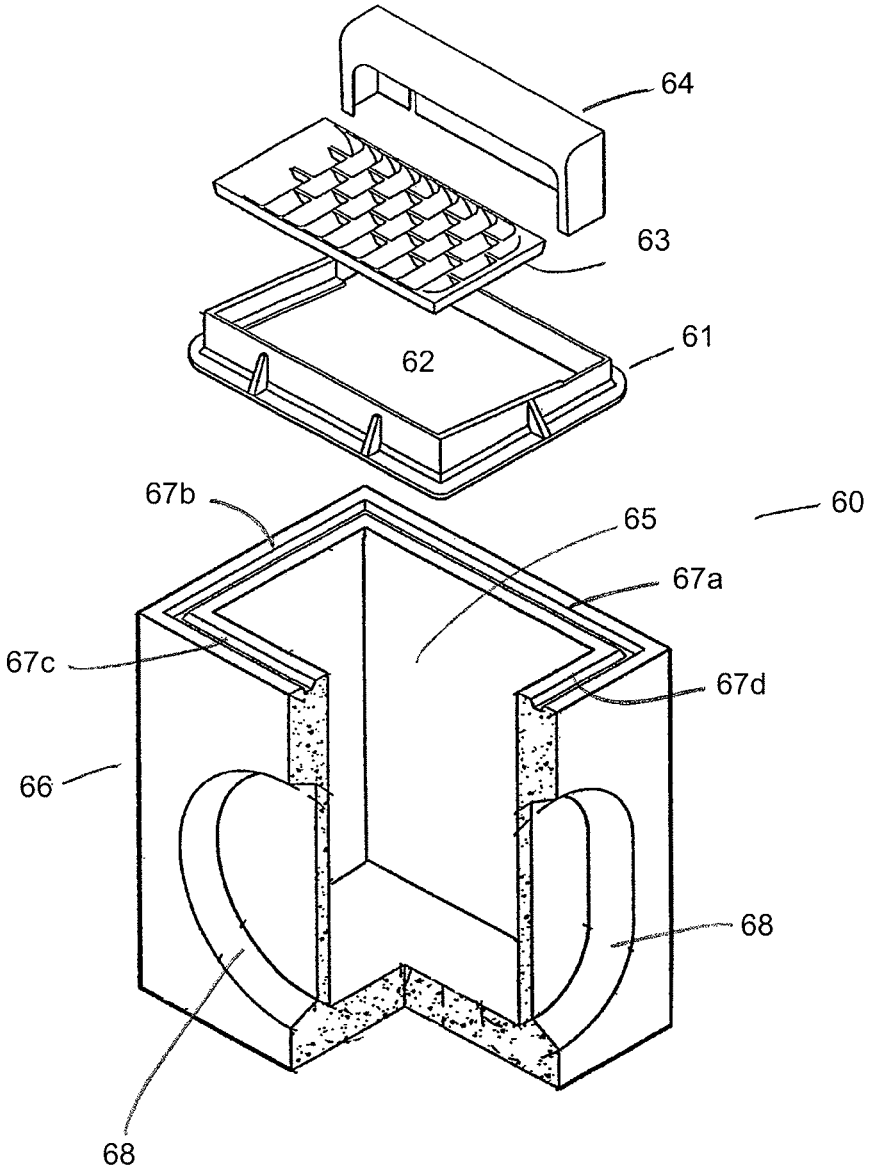
FIG. 6 is a perspective cutaway assembly view of a standard curb inlet with a top grate, grate frame, hood, and rectangular vertical walls.

Referring now to FIG. 6, a common curb inlet 60 is shown in a perspective cutaway assembly view. The inlet 60 includes a grate frame 61 supporting a metal top grate 63 and hood 64 covering the surface opening 62, into which runoff draining from the street surface above falls through the grate 63 into the interior compartment 65 of precast concrete catch basin 66. The interior compartment 65 of the catch basin 66 is bounded by vertical walls 67*a*, 67*b*, 67*c*, and 67*d*, which form a rectangular cross-sectional area as the walls 67*a*, 67*b*, 67*c*, and 67*d* extend vertically down from the surface opening 62 to the bottom of the catch basin 66. The catch basin 66 is provided with outlets opening 68 for connecting, e.g., to a sewer system or other downstream body of water.

A common design feature of these storm water inlets is the vertical interior wall or walls of the precast concrete catch basin extending below the surface opening of the inlet to the bottom of the basin. These walls, as shown in figures FIGS. 1-6, define a cross-sectional area at a distance below the surface opening within the interior compartment, and that cross-sectional area often takes the form of a circle, ellipse, or rectangle. The filter according to the invention therefore comprises one or more molded, porous filter elements, the element or elements being formed such that, when installed in the precast catch basin of a storm water inlet, the filter substantially fills the entire cross-sectional area of the interior compartment within the vertical wall or walls catch basin below the surface opening. This configuration ensures that no substantial portion of the runoff entering the catch basin evades the filter. In a preferred embodiment, the filter element or elements are provided with a means for lifting, such as a lug, a hook, or an eye ring, for example, to facilitate the installation and removal of the filter in and from the storm water inlet. In a further preferred embodiment, one or more of the filter elements comprise precast pervious concrete.

In a further aspect, the present invention is a storm water inlet incorporating the filter of the invention. Accordingly, the inlet has a surface opening that receives storm water runoff comprising liquids and solids and discharges the runoff into an interior compartment below the surface opening. The interior compartment of the inlet has a substantially vertical interior wall or walls that define a cross-sectional area. Finally, the inlet includes a filter comprising one or more molded, porous filter elements, the element or elements being formed such that the filter substantially fills the entire cross-sectional area of the interior compartment when positioned therein.

Figure 7:
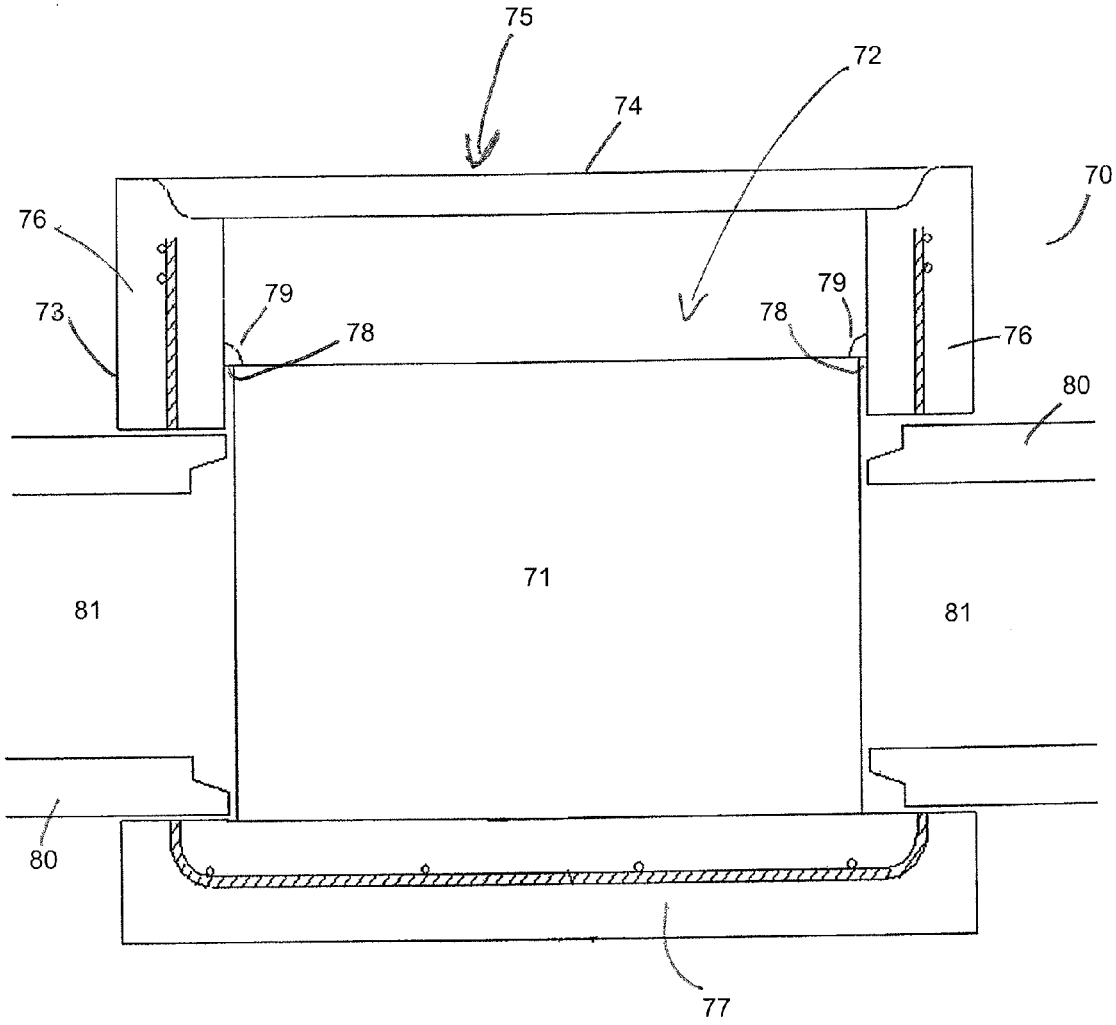
FIG. 7 is a side elevation cutaway assembly view of a storm water inlet according to a preferred embodiment of this invention, showing the filter installed in the interior compartment of the catch basin.

Referring now to FIG. 7, a storm water inlet 70 according to a preferred embodiment of this invention is shown in side elevation cutaway assembly view with the inventive filter 71 installed in the interior compartment 72 of the catch basin 73. The inlet 70 is provided with a metal top grate 74 covering surface opening 75. The opening sits above the interior compartment 72 of the precast reinforced concrete catch basin 73 defined by vertical walls 76 and bottom wall 77. The filter 71 is formed such that it fills substantially the entire cross-sectional area of the interior compartment 72 and extends to the bottom wall 77 of the compartment 72. A continuous joint 78 between the filter 71 and the vertical walls 76 is filled with sealant 79. Sewer pipes 80 connect to the catch basin interior compartment 72 via connecting openings 81 in the catch basin 73.

In a preferred embodiment of the storm water inlet of the present invention, the vertical wall or walls of the interior compartment of the catch basin form a substantially circular, elliptical, or rectangular cross-sectional area. It is also preferred that the interior compartment comprises a catch basin having one or more outlet openings connected to a storm sewer. A preferred storm water inlet according to the invention is provided with a means for access to the interior compartment for installing and removing the filter. Such means may include a manhole with a removable manhole cover and/or a feature wherein the grate covering the surface opening may be removed or opened to provide access to the interior compartment of the catch basin.

As shown in FIG. 7, in a preferred embodiment the filter substantially fills the interior compartment. The filter forms a continuous joint with the walls defining the cross-sectional area of the interior compartment, which joint can be sealed with a sealant. It is also preferred that the filter element or elements that form the filter have a means for lifting to facilitate installation and removal of the filter in and from the catch basin interior. In a further preferred element, the filter is composed of one or more filter elements formed of a precast pervious concrete. Preferably, the filter is formed of a single filter element.

In a further aspect, the present invention is a method of adding a filter to a storm water inlet having a surface opening that receives storm water runoff comprising liquids and solids and discharges the runoff into an interior compartment below the surface opening. The interior compartment of the inlet has a substantially vertical interior wall or walls defining a cross-sectional area. The method according to the invention includes the steps of determining the shape of the cross-sectional area of the interior compartment, and casting and hardening one or more filter elements comprising a porous material, preferably a pervious concrete, to form a filter that substantially fills the entire cross-sectional area of the interior compartment, such that substantially all runoff entering the interior compartment will encounter the filter.

The filter can be precast and installed in the catch basin or formed in place in the basin. Thus in one embodiment, the inventive method may further include the steps of forming a mold or combination of molds for casting the one or more filter elements to form the filter that will substantially fill the entire cross-sectional area of the interior compartment, casting and hardening the porous material, preferably a pervious concrete, in the one or more molds to form the one or more filter elements, and installing the one or more filter elements within the interior compartment of storm water inlet.

As shown in FIG. 7, in a preferred embodiment the filter may be formed so that it substantially fills the interior compartment of the catch basin in which it is to be installed, extending fully to its bottom. However, the catch basin may have protrusions or other obstructions projecting into the catch basin interior compartment that would interfere with the installation of a figure so configured. Thus, in an alternate embodiment, the filter is configured such that it fills substantially all of the cross-sectional area of the catch basin interior compartment at some distance below the surface opening, but not so far as to encounter any obstructions within the catch basin. As will be appreciated by those of skill, it may be necessary to modify a given precast concrete catch basin design to provide a means for suspending the filter within the basin if it is not possible to rest the filter on the basin bottom. Such modifications are within the capability of a person of skill and may include brackets, angles irons, rods, pins, bolts, hooks, ledges, or any other mechanical means by which the filter can be suspended within the catch basin interior and at the same time fill the cross-section of the catch basin.

These and other aspects of the invention provide advantages over known catch basin filters. Because the filter fills a cross-section of the catch basin, and in a preferred embodiment is sealed against the catch basin walls, virtually no runoff can bypass treatment by the filter. Large objects, debris, and trash will be retained in the upper end of the catch basin nearer the maintenance access where they can be collected more conveniently during maintenance than from the bottom of the catch basin. Moreover, the liquid component carrying dissolved and suspended contaminants is provided with the beneficial treatment of concrete filtration, which simultaneously removes organic, metallic, and biological contaminants. The pervious concrete filter elements are durable, robust, and themselves require little to no maintenance save for replacement after their expected service life of several years.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A filter for a storm water inlet having a surface opening for receiving storm water runoff comprising liquids and solids and discharging said runoff into an interior compartment below having a substantially vertical interior wall or walls defining a space and a bottom wall, the substantially vertical interior wall or walls including a pair of openings, said filter comprising one or more molded, porous filter elements, said element or elements being formed such that the filter contacts the bottom wall and substantially fills the entire space of the interior compartment between the pair of openings, said one or more elements having a hydraulic conductivity of from 30 in/hr up to 900 in/hr.

2. The filter of claim 1, formed to fill a substantially circular, elliptical, or rectangular space of the interior compartment.

3. The filter of claim 1, wherein the filter element or elements have a means for lifting.

4. The filter of claim 1, wherein one or more of the filter elements comprise precast pervious concrete.

5. A storm water inlet, comprising:

a. a surface opening for receiving storm water runoff comprising liquids and solids and discharging said runoff into an interior compartment below;

b. the interior compartment having a substantially vertical interior wall or walls defining a space and a bottom wall, the substantially vertical interior wall or walls including a pair of openings; and c. a filter comprising one or more molded, porous filter elements, said element or elements being formed such that the filter contacts the bottom wall and substantially fills the entire space of the interior compartment between the pair of openings, said one or more elements having a hydraulic conductivity of from 30 in/hr up to 900 in/hr.

6. The storm water inlet of claim 5, wherein the interior compartment walls form a substantially circular, elliptical, or rectangular space.

7. The storm water inlet of claim 5, wherein the interior compartment comprises a catch basin having one or more outlet openings connected to a storm sewer.

8. The storm water inlet of claim 5, wherein the filter substantially fills the interior compartment.

9. The storm water inlet of claim 5, wherein the filter element or elements have a means for lifting.

10. The storm water inlet of claim 5, wherein one or more of the filter elements comprise precast pervious concrete.

11. The storm water inlet of claim 5, wherein the filter comprises a single filter element.

12. The storm water inlet of claim 5, having a means for access to the interior compartment for installing and removing the filter.

13. The storm water inlet of claim 5, wherein the filter forms a continuous joint with the walls defining the space of the interior compartment.

14. The storm water inlet of claim 13, wherein the joint is sealed.

15. A method of adding a filter to a storm water inlet that comprises a surface opening for receiving storm water runoff comprising liquids and solids and discharging said runoff into an interior compartment below, the interior compartment having a substantially vertical interior wall or walls defining a space and a bottom wall, the substantially vertical interior wall or walls including a pair of openings, the method comprising the steps of:

a. determining the shape of the pace of the interior compartment;

b. casting and hardening one or more filter elements comprising a porous material to form a filter that has a hydraulic conductivity of from 30 in/hr up to 900 in/hr and contacts the bottom wall and substantially fills the entire space of the interior compartment between the pair of openings, such that the filter substantially fills the entire space of the interior compartment and substantially all runoff entering the interior compartment through either opening will encounter the filter.

16. The method of claim 15, further comprising in step b., the steps of:

c. forming a mold or combination of molds for casting the one or more filter elements, wherein the filter element or elements form a filter that substantially fills the entire space of the interior compartment;

d. casting and hardening the porous material in the one or more molds to form the one or more filter elements; and e. installing the one or more filter elements within the interior compartment of storm water inlet.

17. The method of claim 15, wherein the porous material comprises a pervious concrete.

18. The method of claim 15, wherein the interior compartment walls form a substantially circular, elliptical, or rectangular space.

19. The method of claim 15, wherein the interior compartment comprises a catch basin having one or more outlet openings connected to a storm sewer.

20. The method of claim 15, wherein the filter substantially fills the interior compartment.

21. The method of claim 15, wherein the filter element or elements have a means for lifting.

22. The method of claim 15, wherein the filter forms a continuous joint with the walls defining the space of the interior compartment.

23. The method of claim 22, further comprising sealing the joint with a sealant.

* * * * *